US008833624B2

(12) United States Patent
Miyamoto

(10) Patent No.: US 8,833,624 B2
(45) Date of Patent: Sep. 16, 2014

(54) BACKPACK TYPE WORKING MACHINE

(75) Inventor: Takeo Miyamoto, Togane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 64 days.

(21) Appl. No.: 13/231,468

(22) Filed: Sep. 13, 2011

(65) Prior Publication Data

US 2012/0080468 A1 Apr. 5, 2012

(30) Foreign Application Priority Data

Sep. 30, 2010 (JP) ..... 2010-221959

(51) Int. Cl.
*A45F 3/08* (2006.01)
*A45F 3/12* (2006.01)
*A45F 3/04* (2006.01)

(52) U.S. Cl.
CPC ... *A45F 3/08* (2013.01); *A45F 3/12* (2013.01); *A45F 3/047* (2013.01)
USPC ..... 224/628; 224/259; 224/261; 224/643

(58) Field of Classification Search
CPC ..... A45F 3/08; A45F 3/047; A45F 3/04; A45F 3/10
USPC ..... 224/576, 628, 259, 261, 262, 627, 630, 224/633–635, 642–644
See application file for complete search history.

(56) References Cited

U.S. PATENT DOCUMENTS 2,421,244 A * 5/1947 Daiber ..... 224/263
3,921,867 A * 11/1975 Farnbach ..... 224/262
5,366,126 A 11/1994 Dausien
5,449,102 A * 9/1995 Sason ..... 224/632
5,890,640 A * 4/1999 Thompson ..... 224/630
2002/0170932 A1* 11/2002 Higgins et al. ..... 224/156
2009/0104033 A1* 4/2009 Rappin ..... 416/1

FOREIGN PATENT DOCUMENTS

JP 51-087997 U 7/1976

(Continued)

OTHER PUBLICATIONS

Patent Abstracts of Japan, Publication No. 2007-038066, publlished on Feb. 15, 2007 (1 page).

(Continued)

*Primary Examiner* — Brian D Nash
*Assistant Examiner* — Corey Skurdal
(74) *Attorney, Agent, or Firm* — Osha Liang LLP

(57) ABSTRACT

A backpack type working machine has a main unit including a power source and a backpack band detachably attached to the main unit, for a worker to backpack the main unit and perform an operation. The back pack has a pad member including a belt-like cushion material and a belt-like band body extending along the pad member. The band body includes an upper end belt-like part branched from an upper end part of the pad member and an upper end joint for connecting the upper end belt-like part to the main unit. The main unit has an attachment for attaching thereto the upper end joint. When the upper end joint is attached to the attachment, the upper end part of the pad member comes into contact with the main unit from a worker side and is held downward.

5 Claims, 6 Drawing Sheets

(56) References Cited

FOREIGN PATENT DOCUMENTS

| | | | | |
|---|---|---|---|---|
| JP | 5-508780 | A | | 12/1993 |
| JP | 2006-068454 | A | | 3/2006 |
| JP | 2007-038066 | A | | 2/2007 |
| JP | 2007-289816 | A | | 11/2007 |
| JP | 2007289816 | A | * | 11/2007 |
| WO | 2006/090542 | A1 | | 8/2006 |

OTHER PUBLICATIONS

Patent Abstracts of Japan, Publication No. 2006-068454, publlished on Mar. 16, 2006 (1 page).
Notice of Allowance issued in corresponding Japanese Application No. 2010-221959, dated Nov. 13, 2012, with translation (4 pages).
Patent Abstracts of Japan, Publication No. 2007-289816, publication date:Nov. 8, 2011, 1 page.

* cited by examiner

BACKPACK TYPE WORKING MACHINE

BACKGROUND OF THE INVENTION

1. Field of the Invention

The present invention relates to a backpack type working machine.

2. Related Background Art

Backpack type working machines have conventionally been known, each comprising a main unit including a power source and backpack bands detachably attached to the main unit and allowing workers to backpack the main unit and perform operations (see, for example, Patent Literature 1).

Patent Literature 1: Japanese Patent Application Laid-Open No. 2007-289816

SUMMARY OF THE INVENTION

Technical Problem

However, the backpack type working machine disclosed in Patent Literature 1 is hard in its parts where the backpack bands are attached and their vicinity, in which the upper parts are exposed to shoulders of workers in particular, so that the workers may feel uneasiness in their shoulders.

In order to overcome such a problem, it is an object of the present invention to provide a backpack type working machine which allows backpack bands to be attached and detached by operations on a par with those conventionally done and can alleviate the feel of uneasiness in the shoulders of the workers.

Solution to Problem

The backpack type working machine (100) in accordance with the present invention is a backpack type working machine (100), comprising a main unit (1) including a power source and a backpack band (2*a*, 2*b*) detachably attached to the main unit (1), for a worker to backpack the main unit (1) and perform an operation, the backpack band (2*a*, 2*b*) having a pad member (10) including a belt-like cushion material (17) and a belt-like band body (9) extending along the pad member (10); the band body (9) including an upper end belt-like part (27) branched from an upper end part (19) of the pad member (10) and an upper end joint (15) for connecting the upper end belt-like part (27) to the main unit (1); the main unit (1) having an attachment (25) for attaching thereto the upper end joint (15); wherein, when the upper end joint (15) is attached to the attachment (25), the upper end part (19) of the pad member (10) comes into contact with the main unit (1) from a worker side and is held downward.

When the upper end joint (15) of the backpack band (2*a*, 2*b*) is attached to the attachment (25) of the main unit (1) in thus constructed backpack type working machine (100), the upper end part (19) of the pad member (10) including the cushion material (17) is attracted to the main unit (1) from the worker side, so as to come into contact with the main unit (1), and is held downward. Therefore, when backpacked, the upper end part (19) of the pad member (10) intervenes between the vicinity of the attachment (25) of the main unit (1) and a shoulder of the worker, whereby the cushioning effect of the cushion material (17) included in the upper end part (19) alleviates the feel of uneasiness in the shoulder of the worker.

In an example of a structure which effectively manifests the action mentioned above, the upper end joint (15) includes a tubular part (28) disposed at a terminal of the upper end belt-like part (27) and a lock pin (29) insertable into the tubular part (28); the attachment (25) includes a support (30) for winding thereabout the upper end belt-like part (27) from the worker side, an insertion hole (31) adapted to pass therethrough toward the worker the tubular part (28) of the upper end belt-like part (27) wound about the support (30), and a recess (32) opening from a worker-side aperture of the insertion hole (31) toward the worker; when the lock pin (29) is inserted into the tubular part (28) passed through the insertion hole (31), the tubular part (28) is inhibited from returning into the insertion hole (31); and the tubular part (28) having the lock pin (29) inserted thereinto is accommodated in the recess (32).

Preferably, the upper end part (19) of the pad member (10) covers the recess (32) from the worker side in a state where the upper end joint (15) is attached to the attachment (25). In this case, the cushioning effect of the cushion material (17) included in the upper end part (19) of the pad member (10) alleviates the feel of uneasiness in the shoulder of the worker caused by the difference in level between the recess (32) and its surroundings.

Preferably, the main unit (1) has a space (33) above the support (30), the space (33) being adapted to route the upper end part (19) of the pad member (10) above the support (30) when attaching the upper end joint (15) to the attachment (25). In this case, routing the upper end part (19) of the pad member (10) through the space (33) above the support (30) allows the root portion of the upper end belt-like part (27) to approach the insertion hole (31) of the main unit (1), whereby the tubular part (28) can easily be drawn from the recess (32) toward the worker. This facilitates the operation of inserting the lock pin (29) into the tubular part (28).

Advantageous Effects of Invention

Thus, the backpack type working machine of the present invention allows backpack bands to be attached and detached by operations on a par with those conventionally done and can alleviate the feel of uneasiness in the shoulders of the workers.

DESCRIPTION OF THE PREFERRED EMBODIMENTS

Figure 1:
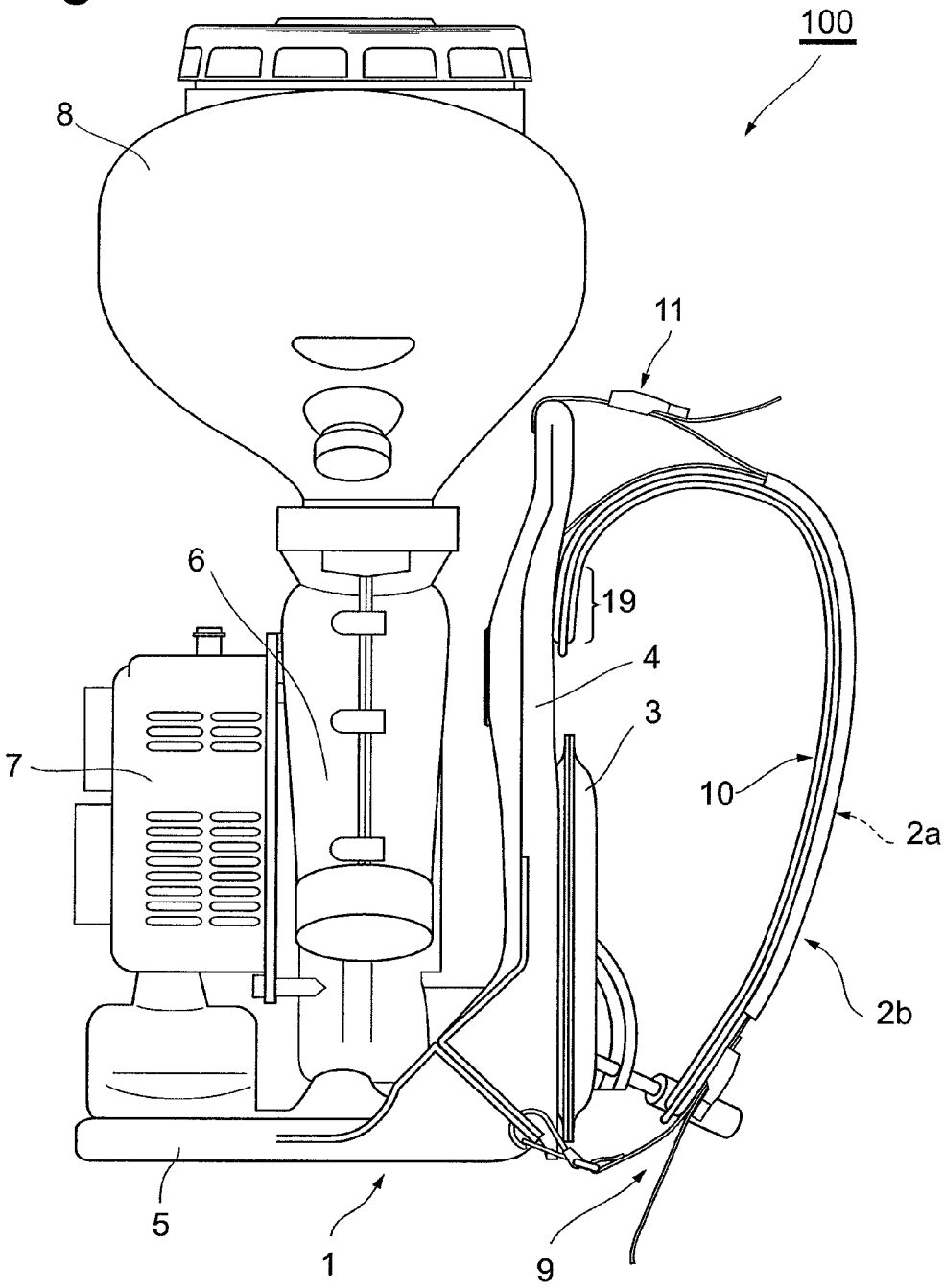
FIG. 1 is a side view of the backpack type working machine in accordance with an embodiment of the present invention.

In the following, preferred embodiments of the backpack type working machine in accordance with the present invention will be explained with reference to the accompanying drawings. In the drawings, the same constituents will be referred to with the same signs while omitting their overlapping explanations. In the following explanations, terms such as upper/lower, front/rear, and left/right will represent directions based on a worker backpacking the backpack type working machine.

Figure 2:
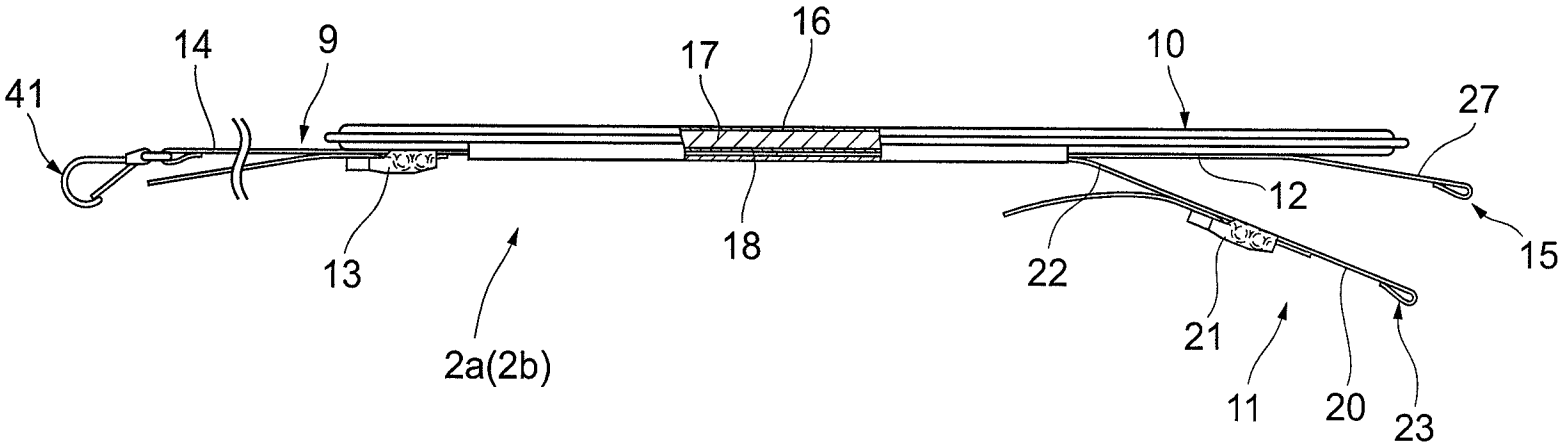
FIG. 2 is a side view of a backpack band.
Figure 3:
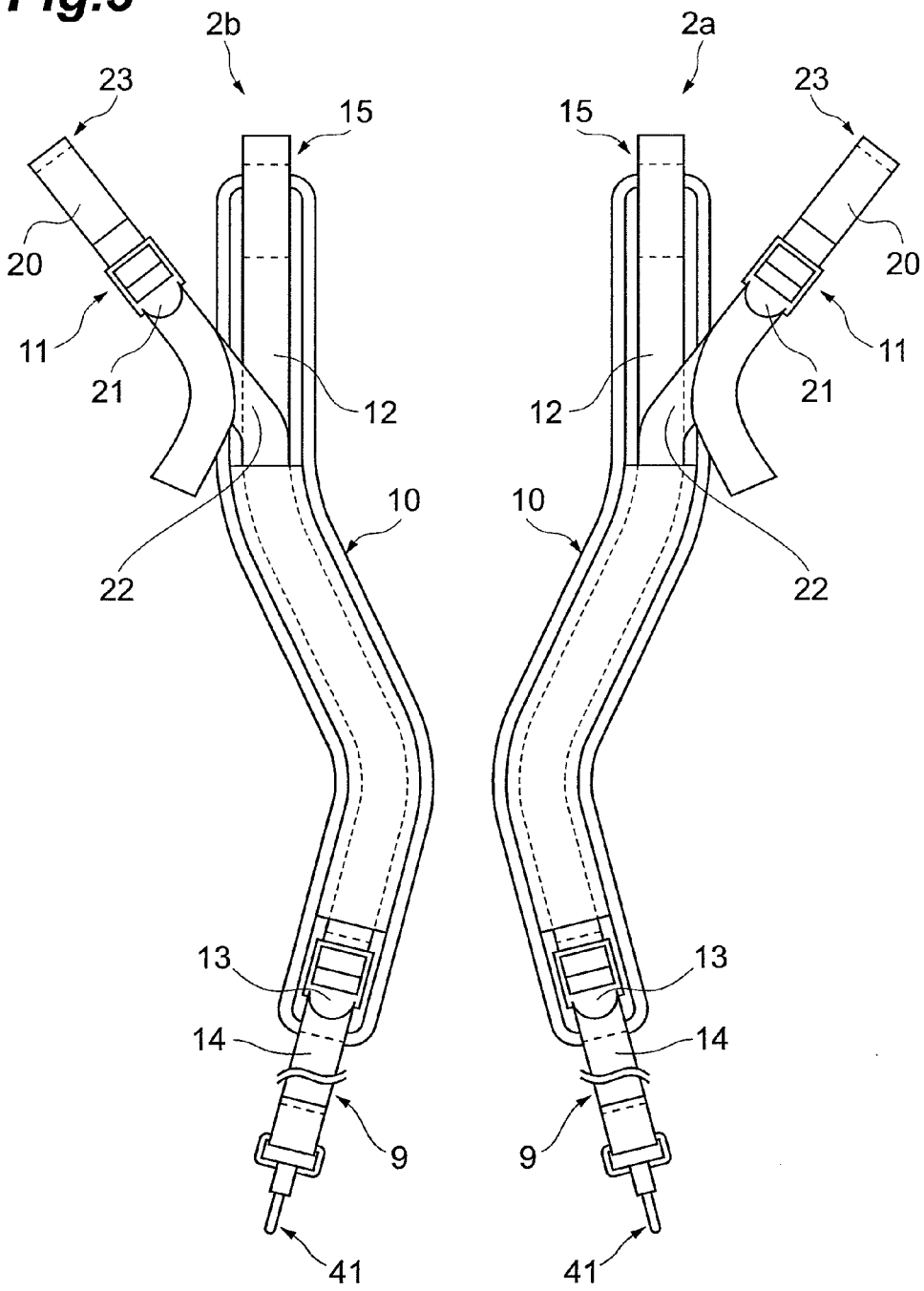
FIG. 3 is a front view of backpack bands.
Figure 4:
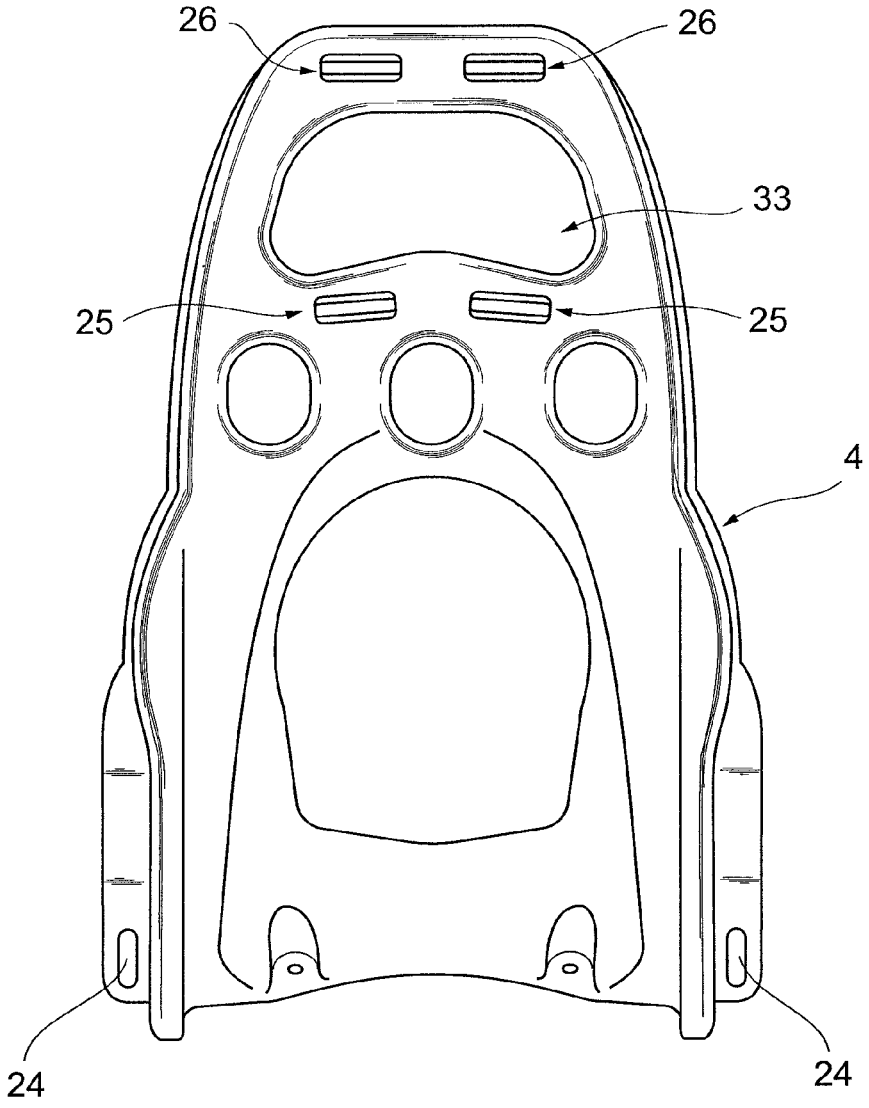
FIG. 4 is a front view of a backpack frame.
Figure 5:
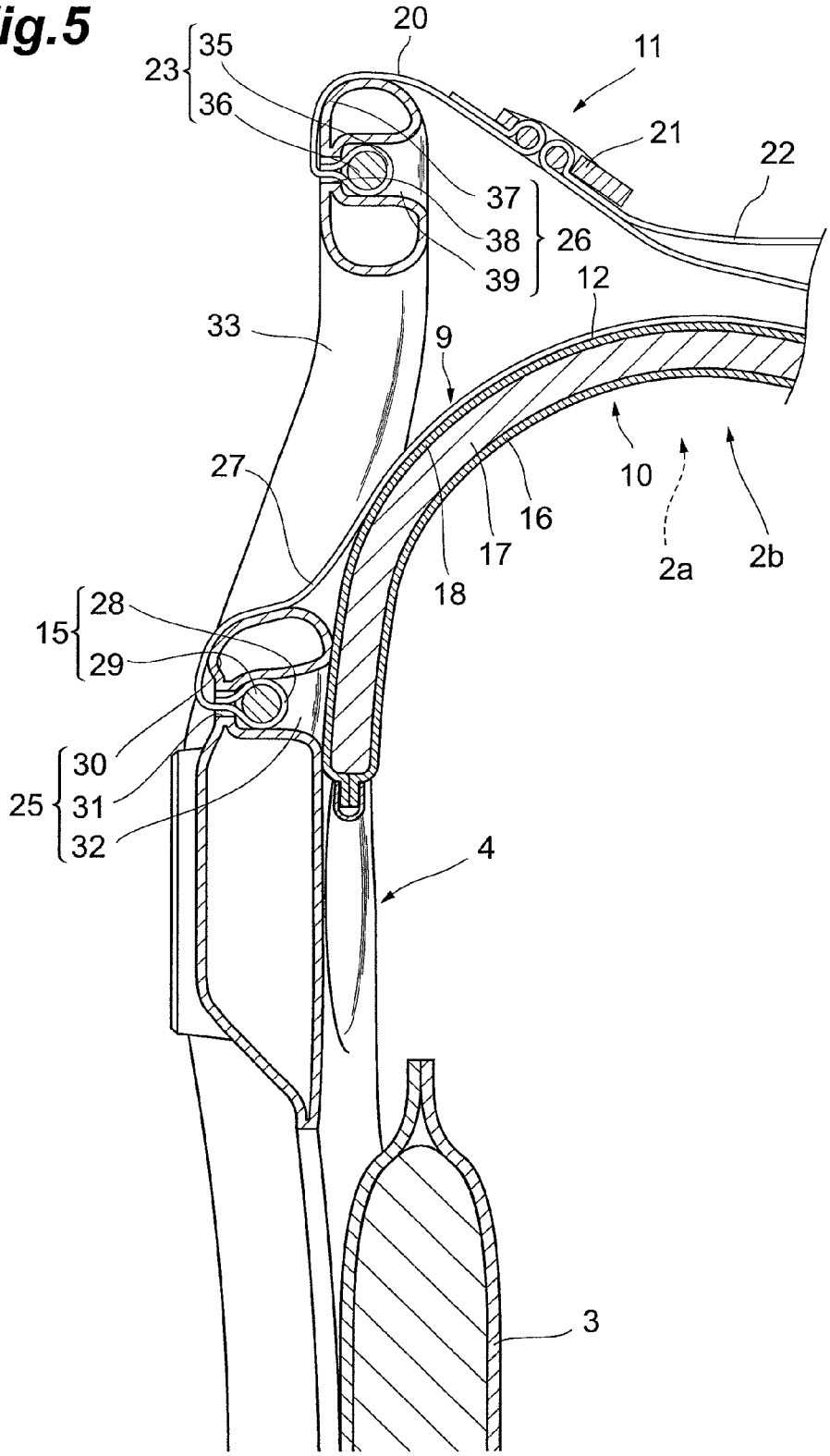
FIG. 5 is a sectional view illustrating how an upper end part of the backpack band is attached.
Figure 6:
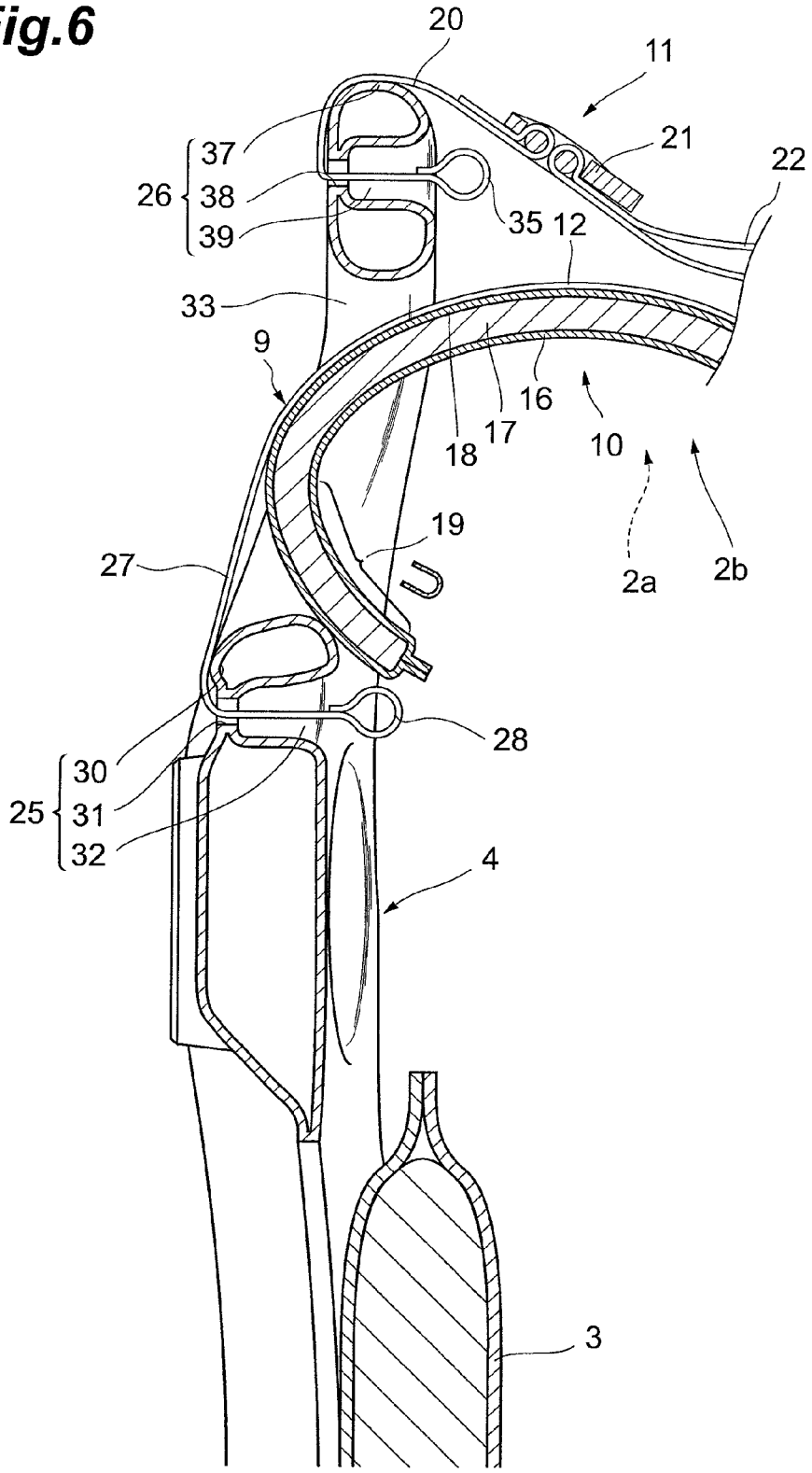
FIG. 6 is a sectional view illustrating a process of attaching the upper end part of the backpack band.

FIG. 1 is a side view of the backpack type working machine in accordance with an embodiment of the present invention, FIG. 2 is a side view of a backpack band, FIG. 3 is a front view of backpack bands, FIG. 4 is a front view of a backpack frame, FIG. 5 is a sectional view illustrating how the backpack band is attached, and FIG. 6 is a sectional view illustrating a process of attaching the backpack band. In this embodiment, the backpack type working machine will be explained as a backpack type power sprayer used for spraying agents and the like.

As illustrated in FIG. 1, the backpack type power sprayer 100 in accordance with this embodiment comprises a main unit 1 including a power source, a pair of left and right backpack bands 2*a*, 2*b* for the worker to backpack the main unit 1, and a back support member 3 adapted to intervene between the main unit 1 and the back of the worker upon backpacking. The backpack power sprayer 100 is also equipped with a spray nozzle for the worker to spray an agent fed from the main unit 1. Here, the spray nozzle is removed.

The main unit 1 comprises a backpack frame 4 to be backpacked by the worker and a mount 5 joining with the lower end of the backpack frame 4 and projecting rearward. A blower 6 for pressure-feeding an agent constituted by a liquid or powder/granular material (granular agent here) in order to spray it and a power source (internal combustion engine here) 7 therefor are mounted on the mount 5, while a tank 8 for accommodating the agent is placed on the blower 6. The back support member 3 is attached to the front side of the backpack frame 4.

Each of the upper end parts of the pair of left and right backpack bands 2*a*, 2*b* is attached to the upper side of the backpack frame 4 with a detachable structure (see FIG. 5), while each of their lower end parts is attached to the lower side of the backpack frame 4 with a detachable structure. By passing both shoulders through a pair of left and right loops constituted by their corresponding backpack bands 2*a*, 2*b* and the backpack frame 4, the worker can backpack the main unit 1.

As illustrated in FIG. 2, each of the backpack bands 2*a*, 2*b* has a pad member 10 including a belt-like cushion material 17, a belt-like band body 9 extending along the outer side (lower side in the drawing) of the pad member 10, and an auxiliary band 11 branched outward from the band body 9 on the upper side of the band body 9.

The pad member 10 is constructed by stacking an inner cover sheet 16, the cushion material 17, and an outer cover sheet 18 in this order from the inner side (the worker side; the upper side in the drawing), so that the inner cover sheet 16 comes into contact with the worker upon backpacking. The cushion material 17 is made of a foam material such as a sponge, for example. The inner cover sheet 16 is made of a mesh material, which restrains the contact area between the pad member 10 and the worker from becoming humid. The outer cover sheet 18 is made of a material (e.g., a vinyl sheet) different from that of the inner cover sheet 16, so that two sides of the pad member 10 are easily distinguishable from each other according to the difference in their materials. The length of the pad member 10 is set such that the lower end part of the pad member 10 is located at the lower end part of the backpack frame 4 in the state where the backpack band 2*a*, 2*b* is attached to the backpack frame 4.

The band body 9 has an upper band 12 to be carried on a shoulder of the worker and a lower band 14 connected to the lower end part of the upper band 12 through a buckle 13, while the total length of the backpack band 2*a*, 2*b* is from the upper end of the upper band 12 to the lower end of the lower band 14. The upper end part of the lower band 14 is turned down at the buckle 13. The turndown position can be changed, so as to adjust the distance between a lower end joint 41 and the buckle 13, thereby regulating the total length of the band body 9. The upper band 12 constituting the band body 9 includes an upper end band-like part 27 branched from an upper end part 19 of the pad member 10 and an upper end joint 15 for connecting the upper end belt-like part 27 to the backpack frame 4. When connecting the upper end joint 15 to the upper side of the backpack frame 4, the upper end part 19 of the pad member 10 is separated from the band body 9 and comes into contact with the backpack frame 4, so as to be held downward (see FIG. 1). The part of the upper band 12 excluding the upper and lower end parts thereof is sewn onto the pad member 10, whereby the length of the pad member 10 is held constant. The lower band 14 includes the lower end joint 41 for connecting the lower end part of the lower band 14 to the backpack frame 4.

As illustrated in FIGS. 2, 3, and 5, the auxiliary band 11 has an upper auxiliary band 20 and a lower auxiliary band 22 connected to the lower end part of the upper auxiliary band 20 through a buckle 21. The upper end part of the upper auxiliary band 20 has an auxiliary joint 23 for connecting with the upper side of the backpack frame 4. The lower end part of the lower auxiliary band 22 is sewn onto the upper band 12 from the outside. The upper end part of the lower auxiliary band 22 is turned down at the buckle 21. The turndown position can be changed, so as to adjust the distance between the lower end part of the lower auxiliary band 22 and the buckle 21, thereby regulating the total length of the auxiliary band 11. The auxiliary joint 23 is attached to the backpack frame 4 at a position higher than the upper end joint 15 of the band body 9, so that the auxiliary band 11 acts such as to attract the band body 9 to the upper side of the backpack frame 4. This action allows the center of gravity of the main unit 1 to approach the worker backpacking the main unit 1, thereby providing the worker with a stable backpacking feel. Adjusting the length of the auxiliary band 11 can control the backpacking feel according to the body shape and liking of the worker.

As illustrated in FIG. 3, the pair of left and right bands 2*a*, 2*b* are bilaterally symmetrical to each other when seen from the front side. The backpack bands 2*a*, 2*b* curve outward on the left and right sides of the worker on the upper side of their centers, respectively. This makes it harder for the neck part of the worker to be pressed from the left and right sides. On the other hand, the parts near the centers of the backpack bands 2*a*, 2*b* on the lower side curve inward on the left and right sides of the worker, respectively, while the lower end parts of the backpack bands 2*a*, 2*b* are directed outward on the left and right sides, respectively. This routes the lower end parts of the backpack bands 2*a*, 2*b* to sides of the body of the worker, thereby providing the worker with a favorable fitting feel.

As illustrated in FIG. 4, the backpack frame 4 has a pair of attachment holes 24, 24 at left and right end portions of its lower end part, while the lower end joints 41, 41 of the backpack bands 2*a*, 2*b* are connected thereto, respectively. The backpack frame 4 also has a pair of left and right attachments 25, 25 on the upper side and, on their upper side (at the upper end part here), a pair of left and right auxiliary attachments 26, 26. The upper end joints 15, 15 of the backpack bands 2*a*, 2*b* are connected to the attachments 25, 25, respectively. The auxiliary joints 23, 23 of the backpack bands 2*a*, 2*b* are connected to the auxiliary attachments 26, 26, respectively.

A structure for connecting the upper end parts of the backpack bands 2*a*, 2*b* to the backpack frame 4 will now be explained with reference to FIGS. 5 and 6. As illustrated in FIG. 5, the upper end joint 15 of the upper band 12 includes a tubular part 28 disposed at a terminal of the upper end belt-like part 27 and a lock pin 29 insertable into the tubular part 28. The tubular part 28 is formed by turning down the upper end of the upper end belt-like part 27 and sewing its overlapping portions together. On the other hand, the attachment 25 includes a support 30 for winding thereabout the upper end belt-like part 27 on the upper side from the worker side, an insertion hole 31 disposed under the support 30 and adapted to insert therethrough toward the worker the tubular part 28 of the upper end belt-like part 27 wound about the support 30 while collapsing the tubular part 28, and a recess 32 opening toward the worker side where a worker-side aperture part of the insertion hole 31 is a bottom part. A space forming hole passing through the backpack frame 4 from its front side to rear side is formed above the support 30 (see FIG. 4). The space forming hole constitutes a space 33 adapted to route the upper end part 19 of the pad member 10 above the support 30 when attaching the upper end joint 15 to the attachment 25.

Winding the upper end belt-like part 27 about the support 30, collapsing and passing the tubular part 28 through the insertion hole 31, and inserting the lock pin 29 into the tubular part 28 passed through the tubular part 28 attaches the upper end joint 15 to the attachment 25. When inserting the lock pin 29 into the tubular part 28, the upper end part 19 of the pad member 10 is curved such as to enter the space 33 and routed above the support 30 as illustrated in FIG. 6. As a consequence, the root portion of the upper end belt-like part 27 approaches the insertion hole 31, so that the tubular part 28 is drawn toward the worker, whereby the lock pin 29 is inserted easily. The tubular part 28 having the lock pin 29 inserted thereinto is accommodated in the recess 32 as illustrated in FIG. 5. The tubular part 28 accommodated in the recess 32 is prevented by the lock pin 29 from collapsing and therefore inhibited from returning into the insertion hole 31, so as to be held within the recess 32. Thus, the upper end belt-like part 27 is connected to the backpack frame 4 of the main unit 1.

In this state, the upper end part 19 of the pad member 10 is attracted by the upper end belt-like part 27 from the worker side to the backpack frame 4 of the main unit 1, so as to come into contact with the backpack frame 4, and held downward while covering the recess 32 from the worker side. Here, holding the upper end part 19 of the pad member 10 downward is achieved by appropriately setting the length of the upper end belt-like part 27 according to the size of the support 30 and the like.

As illustrated in FIG. 5, the auxiliary joint 23 of the auxiliary band 11 includes a tubular part 35 and a lock pin 36 as constituents corresponding to those of the upper end joint 15. On the other hand, the auxiliary attachment 26 includes a support 37, an insertion hole 38, and a recess 39 as constituents corresponding to those of the attachment 25. The auxiliary joint 23 is attached to the auxiliary attachment 26 like the upper end joint 15 to the attachment 25.

In thus constructed backpack power sprayer 100, when the upper end joint 15 of the backpack band 2*a*, 2*b* is attached to the attachment 25 of the backpack frame 4, the upper end part 19 of the pad member 10 including the cushion material 17 is attracted from the worker side to the backpack frame 4, so as to come into contact with the backpack frame 4, and held downward, whereby the upper end part 19 of the pad member 10 intervenes between the vicinity of the attachment 25 of the backpack frame 4 and a shoulder of the worker, so that the cushioning effect of the cushion material 17 included in the upper end part 19 alleviates the feel of uneasiness in the shoulder of the worker.

When the terminal of the upper end part 19 of the pad member 10 is held downward, the root portion of the upper end part 19 is held upward, so that parts in the vicinity of the upper end part 19 are lifted by the elastic force of the cushion material 17 such as to be attracted toward the backpack frame 4, whereby the loop formed by the backpack frame 4 and the backpack band 2*a*, 2*b* is held in an open state. The lower end part of the pad member 10 is located at the lower end part of the backpack frame 4 and thus comes into contact with the floor surface when the backpack power sprayer 100 is placed on the floor, whereby the loop formed by the backpack frame 4 and the backpack band 2*a*, 2*b* is more reliably held in the open state. This makes it easier for arms to pass through the backpack bands 2*a*, 2*b*, whereby the main unit 1 can be backpacked easily.

Since the recess 32 is covered with the upper end part 19 of the pad member 10 in the state where the upper end joint 15 is attached to the attachment 25, the cushioning effect of the cushion material 17 included in the upper end part 19 of the pad member 10 alleviates the feel of uneasiness in the shoulders of the worker caused by the difference in level between the recess 32 and its surroundings.

Since the space 33 adapted to route the upper end part 19 of the pad member 10 above the support 30 is formed, routing the upper end part 19 above the upper side of the support 30 allows the root portion of the upper end belt-like part 27 to approach the insertion hole 31, whereby the tubular part 28 can easily be drawn from the recess 32 toward the worker, which makes it easier to insert the lock pin 29 into the tubular part 28.

The backpack type working machine is not limited to the backpack power sprayer explained in this embodiment, but is also applicable to backpack blowers and backpack mist sprayers, for example.

What is claimed is:

1. A backpack type working machine, comprising a main unit that includes a power source and a backpack band detachably attached to the main unit, for a worker to backpack the main unit and perform an operation;

wherein the backpack band comprises a pad member including a belt-like cushion material, a belt-like band body extending along the pad member, and an auxiliary band branched outward from the band body;

wherein the band body comprises an upper end belt-like part branched from an upper end part of the pad member and an upper end joint for connecting the upper end belt-like part to the main unit;

wherein the auxiliary band comprises an auxiliary joint for connecting an upper end of the band body to the main unit;

wherein the main unit comprises an attachment for attaching thereto the upper end joint and, on the upper side of the attachment, an auxiliary attachment for attaching thereto the auxiliary joint, wherein the main unit comprises a worker-side surface and a surface opposite to the worker-side surface; and wherein, when the upper end joint is attached to the attachment, more than half of the upper end belt-like part is held between the worker-side surface and the surface opposite to the worker-side surface of the main unit, and wherein, when the auxiliary joint is attached to the auxiliary attachment, the band body is attracted to the upper side of the main unit.

2. The backpack type working machine according to claim 1, wherein the upper end joint includes a tubular part disposed at a terminal of the upper end belt-like part and a lock pin insertable into the tubular part;

wherein the attachment includes a support for winding thereabout the upper end belt-like part from the worker side, an insertion hole adapted to pass therethrough toward the worker the tubular part of the upper end belt-like part wound about the support, and a recess opening from a worker-side aperture of the insertion hole toward the worker;

wherein, when the lock pin is inserted into the tubular part passed through the insertion hole, the tubular part is inhibited from returning into the insertion hole; and wherein the tubular part having the lock pin inserted thereinto is accommodated in the recess.

3. The backpack type working machine according to claim 2, wherein the upper end part of the pad member covers the recess from the worker side in a state where the upper end joint is attached to the attachment.

4. The backpack type working machine according to claim 2, wherein the main unit has a space above the support, the space being adapted to route the upper end part of the pad member above the support when attaching the upper end joint to the attachment.

5. The backpack type working machine according to claim 3, wherein the main unit has a space above the support, the space being adapted to route the upper end part of the pad member above the support when attaching the upper end joint to the attachment.

* * * * *